United States Patent [19]

Makohl

[11] Patent Number: 4,773,489

[45] Date of Patent: Sep. 27, 1988

[54] CORE DRILLING TOOL FOR BOREHOLES IN ROCK

[75] Inventor: Friedhelm Makohl, Hermannsburg, Fed. Rep. of Germany

[73] Assignee: Eastman Christensen Company, Salt Lake City, Utah

[21] Appl. No.: 38,609

[22] Filed: Apr. 15, 1987

[30] Foreign Application Priority Data

Apr. 19, 1986 [DE] Fed. Rep. of Germany ..... 3613265

[51] Int. Cl.[4] ..... E21B 25/02

[52] U.S. Cl. ..... 175/107; 175/246

[58] Field of Search ..... 175/107, 244–252

[56] References Cited

U.S. PATENT DOCUMENTS

| | | | |
|---|---|---|---|
| 2,910,273 | 10/1959 | Bon | 175/246 |
| 2,944,792 | 7/1960 | Gros | 175/246 |
| 3,903,975 | 9/1975 | Sweeney | 175/246 |
| 3,990,524 | 11/1976 | Sweeney | 175/246 |
| 4,452,322 | 6/1984 | Jurgens | 175/107 |
| 4,466,497 | 8/1984 | Soinski et al. | 175/246 |
| 4,518,050 | 5/1985 | Sollie et al. | 175/246 |

*Primary Examiner*—Jerome Massie
*Assistant Examiner*—Bruce M. Kisliuk
*Attorney, Agent, or Firm*—Beehler, Pavitt, Siegemund, Jagger, Martella & Dawes

[57] ABSTRACT

A core drilling tool for bore-holes includes a stem for connection to the string and an outer rotating tube for rotating a drill bit mounted thereon. A core tube is mounted in a central passage by a latch means to remove the core tube and/or replace it. The outer tube is rotated by a downhole motor such as a Moineau type motor. The diameter of the central passage through the stator is equal to the maximum diameter of the core tube plus the eccentricity of the stator to permit passage of the core tube into and out of the tool. Thus coring can be achieved without tripping the tool. Various details of the structure are described.

18 Claims, 1 Drawing Sheet

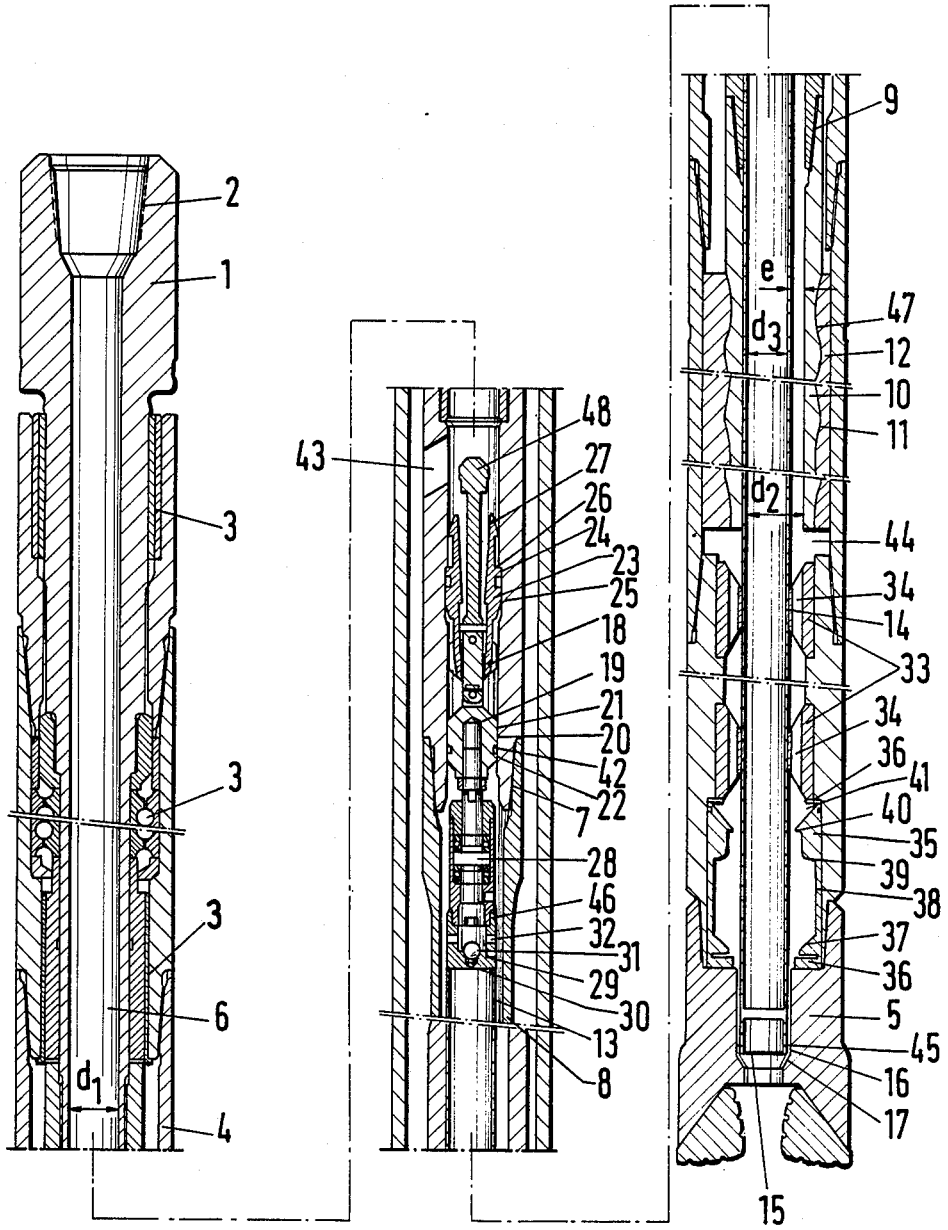
2
1
3
3
3
6
$d_1$
4
43
48
27
26
24
23
25
18
19
21
20
42
22
7
28
46
32
31
29
30
13
8
9
e
$d_3$
47
12
10
11
$d_2$
44
34
14
33
34
36
41
40
35
39
38
37
36
5
45
16
17
15

CORE DRILLING TOOL FOR BOREHOLES IN ROCK

BACKGROUND OF THE INVENTION

1. Field of the Invention

This invention relates to a core drilling tool for boreholes in rock.

2. Description of the Prior Art

German Pat. No. 29 53 873 discloses a tool wherein a universal joint is employed for connecting the core tube to the stator of a motor that operates on the Moineau principle and is driven by the drilling fluid. The core tube is installed in a manner such that it cannot be removed without first performing disassembly operations, so that once a core has been drilled out, it cannot be extracted until the tool has been hoisted to the drilling platform and the subsequent disassembly operations have been performed. In a tool of this type, the stator contains a central passage for the drilling fluid, bypassing the working chambers of the motor in order to supply fluid to the interior of the core tube before the drilling operation commences, the object being to flush the core tube clean, without starting the motor.

In addition to the above, U.S. Pat. No. 3,055,440 discloses a turbine-driven core drilling tool, from which a core tube insert can be hoisted to the drilling platform by means of a catcher device, via a central passage through the turbine, while the drilling tool otherwise remains in its installed state.

An object of the invention is to provide an improved core drilling tool which, when in the installed state, enables cores to be extracted by withdrawing the core tube as a separate compartment.

SUMMARY OF THE INVENTION

According to the present invention I provide a core drilling tool for boreholes, the tool having a central passage therethrough and comprising a stem adapted at its upper end portion for connection to a pipe string, an outer tube rotationally mounted on the stem and having a drilling bit at its lower end, a motor arranged to be driven by drilling fluid comprising a rotor secured to the inside of the outer tube and a stator, defining with the rotor a working chamber of the motor, connected by connecting means to the stem so that rotation of the stator cannot occur, said central passage extending through the stem and stator and the lower end of the outer tube, and a core tube mounted in the central passage, the core tube comprising latch means on an upper end portion thereof by which the core tube is attached to the stem in such a manner that it can rotate relative to the stem but is fixed against axial movement relative to the stem with a lower end of the core tube located in the central passage adjacent the drilling bit but providing an annular gap between the tube and the bit through which drilling fluid can pass, means for releasing the latch means and means by which the core tube can be grasped to withdraw it from the tool through the central passage when the latch means has been released, the stem, connecting element and outer tube together defining an annular space communicating with the central passage above the core tube and leading to the working chamber of the motor and forming part of the flow path of the drilling fluid.

The latch means of a preferred core drilling tool provides automatic axial location of the core tube in relation to the annular gap between its end face and the drilling bit, once the core tube has reached its operating position, either under gravity or with additional assistance that may be provided by the fluid pumps. Preferably seals are provided between the outer cylindrical surface of the core tube and the inside wall surface of the stem, to prevent drilling fluid from flowing through the interior of the stator, thus obliging the whole of the fluid flow to take the path via the working space of the motor.

According to a further aspect of the present invention I provide a core drilling tool for boreholes having a central passage therethrough and comprising a stem adapted at its upper end portion for connection to a pipe string, an outer tube rotationally mounted on the stem and having a drilling bit at its lower end, a motor arranged to be driven by drilling fluid including a helically profiled rotor located on the inside of the outer tube and a cooperating helically profiled hollow stator in driving association with the rotor defining a working chamber therebetween, a connecting element connecting the stator to the stem in such a way that rotation of the stator cannot occur but that movement of the stator transversely is permitted, the central passage extending from the stem through the connecting element and the stator, and a core tube in the central passage having an upper end portion releasably connected to the stem and extending downwardly to terminate adjacent the bit, the stem, connecting element and outer tube together defining an annular space communicating with said central passage above the core tube and leading to the working chamber of the motor and forming part of the flow path of the drilling fluid, wherein the central passage through the stem has a diameter at least equal to the maximum external diameter of the core tube whereby to permit passage of the core tube therethrough and wherein the diameter of the part of the central passage extending through the connecting element and the stator is at least equal to the sum of the maximum outside diameter of the core tube within the connecting element and stator and below the stator, and the eccentricity of the motor.

In a preferred embodiment of the invention, as a result of the choice of diameter for the central passage through the stem, compared to the core tube outside diameter, the core tube can, when necessary, be pulled upwards through the stem, or be lowered into its operating position. This feature also enables the core drilling tool to be used for applications that involve the extraction of a series of cores from one and the same encased seabed borehole, as might be drilled from a floating rig. The choice of the inside diameter of the hollow stator and the design of the connecting element both take account of the outside diameter of the core tube and the eccentricity of the motor, thus enabling the stator to describe the eccentric movement which is conditioned both by its geometry and by that of the rotor, without at the same time coming into contact with the core tube and disturbing its central location. The preferred motor operates on the Moineau principle and possesses a rotor with a spiral profile generally similar to the profile of a worm gear, together with a matching stator.

BRIEF DESCRIPTION OF THE DRAWING

Reference is now made to the accompanying drawing in which the single FIGURE is a view in section of a preferred core drilling tool embodying the invention.

DESCRIPTION OF THE PREFERRED EMBODIMENT

An ilustrative embodiment of the subject matter of the invention is presented in the description which now follows, wherein references are made to the accompanying drawing.

The illustrative core drilling tool comprises a stem 1 which can be connected to a pipe string by means of a threaded socket 2, the pipe string itself being omitted from the drawing. An outer tube 4 is rotatably mounted on the stem 1, by means of a bearing assembly 3, this outer tube 4 carrying a core cutter or a core drilling bit 5 at its lower end. The stem 1 contains a central passage 6, of inside diameter $d_1$, and is connected, at its loer end, to a thin-walled, flexible sleeve 8 which serves as a connecting element, the connecting proper being made via a threaded joint 7. The hollow stator 10 of a fluid-driven motor 11 connects to this sleeve via a further threaded joint 9. The rotor 12 of this motor is located on the inside of the outer tube 4. The rotor 12 and the stator 10 are helically profiled generally similar to the profile of a worm gear, and remain in continuous engagement with each other, forming a working chamber 47. The motor operates on the principle attributed to Moineau. If, in a motor of this type, one of the two parts is fixed in a manner such that it cannot move radially, the other part executes an eccentric orbit. Since, in the present case, the mounting of the outer tube 4, by means of the bearing assembly 3, prevents the rotor 12 from moving radially, the stator 10 has to describe this orbit. The corresponding radial displacement, relative to the stem 1, is rendered possible by the flexible, thin-walled sleeve 8, which at the same time prevents any rotational movement.

The diameter $d_2$, common to the stator 10 and the flexible thin-walled sleeve 8, exceeds that of the central passage 6 through the stem 1, $d_1$by an amount equal to the eccentricity e of the motor 11. This choice of dimensions leads to a situation in which the diameter of the envelope of the eccentric movement of the stator 10, $d_3$, is approximately equal to that of the central passage 6 through the stem 1, namely $d_1$.

A core tube 13 is installed inside both the central passage 6 through the stem 1 and the passage that continues through the flexible sleeve 8, the stator 10 and the lower portion of the outer tube 4. The core tube 13 comprises an inner tube 14, the lower end face 15 of this tube 14 being located near an inwardly extending shoulder 17 of the core drilling bit 5, forming an annular gap 16 for the drilling fluid to pass through. Latch means, namely a latching device 18 serves to fix the core tube 13 so that it cannot move axially. This latching device 18 comprises a cylindrical body 19 which exhibits step-changes in diameter, its radial surface 20 bearing against a radial surface 21 situated in a zone 22 of the central passage 6 through the stem 1, this stem zone 22 likewise exhibiting step changes in diameter, and further comprise latching fingers 23 which are located on its periphery at regular intervals around the central axis, and which possess lugs 24 that engage into a circumferential groove 25 in the central passage 6, and come to bear against the radial surface 26 of this groove. When the core tube is lowered, or pumped down, so as to be inserted into the core drilling tool, the latching fingers 23 are pressed together by the walls of the pipes forming the fluid space within the drilling string, and by the wall surface of the central passage 6 inside the core drilling tool, until the core tube 13 reaches the position shown in the drawing, and the latching fingers 23 can spread outwards, with their lugs 24 entering the circumferential groove 25. At their upper ends, the latching fingers 23 provide release means in the form of a segmented conical guide surface 27, over which a sleeve of a catcher tool can engage, pressing them together and thereby releasing them from their latching engagement with the circumferential groove 25. The core tube 13 can then be hoisted to the drilling platform by means of a wire rope, passing through the motor 11, the flexible thin-walled sleeve 8, the stem 1, and the remainder of the pipe string.

The inner tube 14 of the core tube 13 is coupled to the latching device 18 by means of a bearing 28 that allows rotation to occur. This rotary bearing 28 allows relative rotation between the stem 1 and the inner tube 14, if the inner tube 14 is jammed by a core that has been forced into it, but the pipe string and the stem 1 are rotatable together. The provision of this bearing 28 avoids relative rotation of the latching device 18 with the stem, this being a possible cause of premature wear of the latching elements.

At its upper end, the inner tube 14 carries a nonreturn valve device 29, comprising a central bore 30, a ball 31 that serves to seal this bore 30, and radial bores 32. The non-return valve device 29 balances the fluid pressures within the inner tube 14 and within a space which is enclosed between this tube 14 and the inner surfaces of the flexible thin-walled sleeve 8 and the stator 10. This space communicates with an annular space 44 that is situated below the motor 11. The non-return valve device 29 prevents drilling fluid from continuously flowing downwards through the inner tube and thereby washing out the core. Conversely, however, this valve device 29 enables fluid to escape from the inner tube 14 as it is displaced by the growth of the core into this tube 14. In the zone below the rotor 12, the outer tube 4 is provided with centering collars 33, which centre and stabilize the inner tube 14. These centering collars 33 have fluid ducts 34 extending in an axial direction.

A flooding valve 35 is installed between the lower centering collar 33 and the core drilling bit 5, and is axially clamped between spacers 36. The flooding valve 35 comprises a first, lower zone 37, which expands conically upward, a second, mid-located zone 38, which is cylindrical, a third zone 39, which forms a transition to a smaller diameter, with rounded transitions from the radial surface to the surface of an adjoining fourth zone 40, which is cylindrical, a transition to a yet smaller diameter, and a fifth zone 41 which flares out conically upwards. The importance of the flooding valve 35 resides in its ability to generate turbulence in the drilling fluid while the core tube 13 is being withdrawn, this turbulence agitating the finely particulate drilling debris as the fluid flows through the core drilling bit 5 and up into the core dilling tool, and preventing this debris from being carried higher, and possible finding its way into the motor 11. The turbulence is generated as the fluid flows past the appropriately shaped zones 37 to 41 of the flooding valve 35.

The core drilling tool according to the invention can be lowered into a borehole, or to the seabed, irrespective of whether the core tube 13 is installed. If the drilling tool is lowered empty, the core tube 13 is inserted into the pipe string once the tool has reached the bottom of the borehole, or the seabed, as the case may be, and it is run in under gravity, or with the assistance of the fluid pumps. The motor 11 is not started during this insertion operation, since the drilling fluid that is present in the pipe string flow channel and the central passage 6 through the stem 1 can escape unhindered through the core dilling bit 5. As soon as the core tub 13 has reached its operating position, in that the radial surface 20 of the cylindrical body 19 has come to bear against the radial surface 21 in the latch zone 22 of the stem 1, the lugs 24 on the latching fingers 23 snap in behind the radial surface 26 of the circumferential groove 25, and fix the core tube 13 so that it cannot move axially. At the same time, the flow path through the flexible thin-walled sleeve 8 and the stator 10 is interrupted by a seal 42 that is located on the cylindrical body 19. The drilling fluid now flows via inlet ports 43 inside the stem, and enters an annular space that is formed between the stem 1 and the flexible thin-walled sleeve 8, on the one side, and the outer tube 4 on the other side. In the upper region, this annular space is closed-off by the bearing assembly 3, while in the lower region it leads into the working chamber 47 of the fluid-driven motor 11. If the supply of drilling fluid is maintained, it first flows through the working chamber 47 as the rotor 12 rotates relative to the stator 10, and then enters the annular space 44 that is formed between the outer tube 4 and the inner tube 14 of the core tube 13. From there, the fluid flows onwards, towards the core dilling bit 5, passing through the axial fluid ducts 34 in the centering collars 33 and through the flooding valve 35, before leaving the bit 5 through the gap 16 that is formed between the end face 15 of the inner tube 14 and the shoulder 17 of the bit itself. As drilling progresses, the drilled-out rock core enters the inner tube 14 and displaces the fluid present therein, this fluid escaping via the non-return valve device 29 and passing into the annular space that is formed between the inner tube 14, and the flexible thin-walled sleeve 8 and the stator 10.

If the intention is to extract the core, a catcher tool, attached to a wire rope, is pumped downwards through the pipe string flow channel and the central passage 6 in the stem 1, until it reaches and engages over and grasps a capture spike 48 (which provides means by which the core tool can be grasped to withdraw it from the tool) of the latching device 18, at the same time engaging the guide surfaces and pressing the latching fingers 23 inwards and releasing the latching deive 18. If the core tube is now subjected to a pull force, by means of the rope, core springs 45—located in the bottom zone of the inner tube 14—force themselves into the drilled-out core and, as pulling continues, sever it from the underlying rock. The core tube 13 can now be hoisted to the surface, so that the drilled-out core can be examined. Once this has been done, the core drilling operation can be continued, using another core tube 13, or re-using the original one if the core has been removed, the chosen core tube being inserted into the core drilling tool as already described. Instead of using another identical core tube 13, the inner tube 14 can also be unscrewed from the rotation bearing 28 and the latching device 18, at a threaded joint 46, and these latter components can be attached to a new inner tube 14.

I claim:

1. A core drilling tool for boreholes, the tool having a central passage therethrough and comprising a stem having an upper end portion and an internal wall and adapted at its upper end portion for connection to a pipe string, an outer tube rotationally mounted on the stem and having a drilling bit at its lower end, a motor arranged to be driven by drilling fluid comprising a rotor secured to the inside of the outer tube and a stator, the stator defining with the rotor a working chamber of the motor, connecting means connecting the stator to the stem so that rotation of the stator cannot occur, said rotor having an eccentric motion relative to said stator, said central passage including a portion extending through the stem and stator and the lower end of the outer tube, and a core tube mounted in the central passage, the core tube comprising latch means on an upper end portion thereof by which the core tube is attached to the stem in such a manner that it can rotate relative to the stem but is fixed against axial movement relative to the stem with a lower end of the core tube located in the central passage adjacent the drilling bit but providing an annular gap between the tube and the bit through which drilling fluid can pass, means associated with said latch means for releasing the latch means and means associated with said core tube by which the core tube can be grasped to withdraw it from the tool through the central passage when the latch means has been released; the stem, connecting means and outer tube together defining an annular space communicating with the central passage above the core tube and leading to the working chamber of the motor and forming part of a flow path for flow of the drilling fluid.

2. A core drilling tool according to claim 1 wherein the motor is constructed to operate according to the Moineau principle.

3. A core drilling tool according to claim 1 wherein the rotor has a helical profile and the stator comprises a cooperating helical profile between which the working chamber is defined, and said rotor and said stator each having a center axis of rotation, the axes of rotation of the rotor and the stator being displaced by a predetermined eccentricity.

4. A core drilling tool according to claim 1 wherein the core tube comprises a seal located between the outer surface of the core tube and the internal wall of the stem defining the central passage.

5. A core drilling tool according to claim 4 wherein the core tube comprises an inner tube which is coupled to the latch means by a bearing to permit relative rotation of the inner tube and latch means.

6. A core drilling tool according to claim 5 comprising a non-return valve device at the upper end of the inner tube for balancing drilling fluid pressures within the inner tube and with the pace which is defined by this tube and the inner surfaces of the connecting means and the stator, and which communicates with the annualr space that is situated below the motor.

7. A core drilling tool according to claim 1 wherein there is a zone below the rotor and above the drilling bit into which a portion of said outer tub extends, said portion of said outer tube being provided with collars for centering the core tube, these centering collars comprising axial drilling-fluid ducts.

8. A core drilling tool according to claim 7 wherein between the centering collars and the drilling bit, the outer tube comprises an annular valve, exhibiting a first, lower zone which expands conically upwards, a second, mid-located zone which is cylindrical, a third zone which forms a transition to a smaller diameter with rounded transitions from the radial surface to the cylindrical surface, an adjoining fourth zone which is cylindrical, and a fifth zone which adjoins the zone at its smaller diameter and expands conically upwards.

9. A core drilling tool according to claim 7 wherein, between the centering collars and the drilling bit, the outer tube comprises a valve arranged to produce turbulence in drilling fluid flowing past it.

10. A core drilling tool according to claim 1 comprising means positioned in the internal wall of the stem defining the central passage, for cooperation with the latch means to locate the core tube axially of the tool, in a desired position.

11. A core drilling tool according to claim 3 wherein the connecting means comprising a connecting element which permits movement of the stator transversely while preventing its rotation.

12. A core drilling tool according to claim 11 wherein said connecting element is a hollow thin-walled flexible sleeve.

13. A core drilling tool according to claim 11 wherein the central passage through the stem has a diameter at least equal to the maximum external diameter of the core tube, and wherein the diameter of the portion of the central passage extending through the connecting means and stator is at least equal to the sum of the maximum outside diameter of the core tube within the connecting means and stator and below the stator, and the eccentricity of the motor.

14. A core drilling tool for boreholes having a central passage therethrough and comprising a stem having an upper end portion and adapted at its upper end portion for connection to a pipe string, an outer tube rotationally mounted on the stem and having a drilling bit at its lower end, a motor arranged to be driven by drilling fluid including a helically profiled rotor located on the inside of the outer tube and a cooperating helically profiled hollow stator in driving assoication with the rotor defining a working chamber therebetween, said stator and said rotor having a predetermined eccentricity, a connecting element connecting the stator to the stem in such a way that rotation of the stator cannot occur but that movement of the stator transversely is permitted, the central passage including a portion extending from the stem through the connecting element and the stator, and a core tube in the central passage having an upper end portion releasably connected to the stem and said core tube extending downwardly to terminate adjacent the bit; the stem, connecting element and outer tube together defining an annular space communicating with said central passage above the corde tube and leading to the working chamber of the motor and forming a part of the flow path of the drilling fluid, wherein the central passage through the stem has a diameter at least equal to the maximum external diameter of the core tube whereby to permit passage of the core tube therethrough and wherein the diameter of the said portion of the central passage extending through the connecting element and the stator is at least equal to the sum of the maximum outside diameter of the core tube within the connecting element and stator and below the stator, and the eccentricity of the motor.

15. A core drilling tool for boreholes having a central passage therethrough and comprising a stem having an upper end portion and adapted at its upper end portion for connection to a pipe string, an outer tube rotationally mounted on the stem and having a drilling bit at its lower end, a motor arranged to be driven by drilling fluid including a rotor located on the inside of the outer tube and a cooperating hollow stator defining a working chamber therebetween, the motor being of a type wherein the rotor and stator are eccentric to one another such that when the motor is in operation with the rotor about its axis transverse motion of the stator occurs, a connecting element connecting the stator to the stem in such a way that rotation of the stator cannot occur but that movement of the stator transversely is permitted, the central passage extending from the stem through the connecting element and the stator, and a core tube in the central passage having an upper end portion releasably connected to the stem and extending downwardly to terminate adjacent the bit; the stem, connecting element and the outer tube together defining an annular space communicating with said central passage above the core tube and leading to the working chamber of the motor and forming part of a flow path of the drilling fluid, wherein the central passage through the stem has a diameter at least equal to the maximum external diameter of the core tube whereby to permit passage of the core tube therethrough and wherein the diameter of the part of the central passage extending through the connecting element and the stator is at least equal to the sum of the maximum outside diameter of the core tube within the connecting element and stator and below the stator and the eccentricity of the motor.

16. A core drilling tool for boreholes having a central passage therethrough and comprising a stem having an upper end portion and adapted at its upper end portion for connection to a pipe string, an outer tube rotatably mountd on the stem and having a drilling bit at its lower end, a motor arranged to be driven by drilling fluid including a helically profiled rotor located on the inside of the outer tube and cooperating helically profiled hollow stator in driving association with the rotor defining a working chamber therebetween, the stator being connected to the stem by a hollow connecting element in such a way that rotation of the stator cannot occur but that movement of the stator transversely is permitted, the central passage extending through the stem, connecting element and stator; the stem, connecting element and outer tube together defining an annular space communicating with said central passage and leading to the working chamber of the motor and forming part of a flow path of the drilling fluid, the tool further comprising a core tube mounted centrally within the tool, the core tube having latch means at an upper end portion thereof by which the core tube is fixed against axial movement to the stem, means for releasing the latch means and means by which the core tube can be withdrawn from the tool through said central passage.

17. A tool according to claim 16 wherein said central passage through the stem includes an upper zone, and wherein said stem has a diameter, at least in said upper zone, at least slightly larger than the outside diameter of the core tube whereby the core tube can pass through and wherein the diameter of the part of the central passage extending through the connecting element and stator is at least equal to the sum of the maximum outside diameter of the core tube within the connecting element and stator and below the stator, and the eccentricity of the motor.

18. A core drilling tool for boreholes in rock, comprising a stem having an upper and lower end, said upper being adapted to be connected to a pipe string and which contains a central passage, said central passage having an upper zone and a lower zone, an outer tube rotatably mounted on the stem, said tool carrying a drilling bit at its lower end, a motor which is driven by the drilling fluid, this motor possessing a rotor which is located on the inside of the outer tube, and said motor being profiled in a manner analogous to the tooth system of a worm gear, this motor also possessing a hollow stator which is profiled in a corresponding manner to said rotor, said stator being in continuous engagement with the worm-shaped rotor profile, said stator and said rotor forming a working space, said motor being connected to the lower end of the stem via a hollow connecting element, this connection being such that while rotational stiffness is assured, radial displacement of the stator is rendered possible; the stem, the connecting element and the outer tube together defining an annular space having an upper and lower region, inlet port means providing fluid communication between said annular space and the central passage through the stem, said central passage through said stem being closed-off in the upper region, and the lower region of said annular space blending into the working chamber of the fluid-driven motor and forming a portion of an axial flow path followed by the fluid, and a core tube having a lower end face, said core tube being installed inside the outer tube in a manner such that said core tube is rotationally decoupled, the lower end face of this core tube being located near the drilling bit and spaced therefrom to maintain an annular gap through which the fluid can pass, wherein the central passage through the stem has a diameter, at least in the upper zone, equal to the largest outside diameter of the core tube, wherein the inside diameter of said core tube which is common to the hollow stator and the connecting element is at least equal to the sum of the outside diameter of the lower zone of the core tube and the eccentricity of the motor, and wherein the core tube is provided at the upper end thereof with a latching device which serves to bring about fixing the inside stem and preventing axial movement while still being releasable, seal means located between the outer cylindrical surface of the core tube and the inside wall surface of the stem to minimize mud penetration therebetween, and said latching device being provided with a catcher arm.

* * * * *